United States Patent [19]

Toder

[11] Patent Number: 4,576,096

[45] Date of Patent: Mar. 18, 1986

[54] WHEELED LOCKING CARRIER

[76] Inventor: Ellis I. Toder, 431 Militia Hill Rd., Fort Washington, Pa. 19034

[21] Appl. No.: 639,695

[22] Filed: Aug. 13, 1984

[51] Int. Cl.[4] ..... B61H 7/04; B61B 3/00

[52] U.S. Cl. ..... 104/94; 16/102; 105/155; 188/42; 188/67

[58] Field of Search ..... 16/102; 104/89, 94; 105/148, 155; 188/42, 67, 71.3

[56] References Cited

U.S. PATENT DOCUMENTS

| | | | |
|---|---|---|---|
| 1,188,991 | 1/1916 | Putnam | 188/42 X |
| 2,134,755 | 11/1938 | Frank et al. | 105/155 |
| 3,310,003 | 3/1967 | Bryan | 104/94 |
| 3,814,023 | 6/1974 | Stantial | 104/94 |
| 3,936,906 | 2/1976 | Takazawa | 188/42 X |
| 4,229,857 | 10/1980 | Toder | 16/102 X |
| 4,246,846 | 1/1981 | Betschart | 188/42 X |

FOREIGN PATENT DOCUMENTS

| | | | |
|---|---|---|---|
| 1345561 | 11/1963 | France | 104/94 |
| 850201 | 10/1960 | United Kingdom | 104/94 |
| 775006 | 11/1980 | U.S.S.R. | 105/148 |

*Primary Examiner*—Robert B. Reeves
*Assistant Examiner*—David F. Hubbuch
*Attorney, Agent, or Firm*—Walter B. Udell

[57] ABSTRACT

A locking wheeled locking carrier including a pair of identical molded half carriage parts each of which carries a pair of canted wheels to support the carrier within a track, and a pendulum part pivoted between the carriage halves and extending downward through the bottom slot in the ceiling track for suspending a desired article. The two carriage halves are slidably interfitted with one another for lateral movement toward and away from one another within the ceiling track, and the pendulum pivot extends slidably through both carriage halves. In the vertical pendulum position a camming action exerted by the pendulum on the two carriage halves forces the carriage halves laterally apart from one another so that their outside surfaces engage the ceiling track slot walls and frictionally lock the carriage in position. When the pendulum is pivoted longitudinally in either direction relative to the carriage halves and the running length of the ceiling track the lateral camming action exerted by the pendulum on the carriage halves is released so that the outer surfaces of the carriage halves disengage from the ceiling track slot wall side surfaces and the carriage is free to travel through the track, it being relockable in its new position by again moving the pendulum to its vertical position.

16 Claims, 7 Drawing Figures

FIG. 1
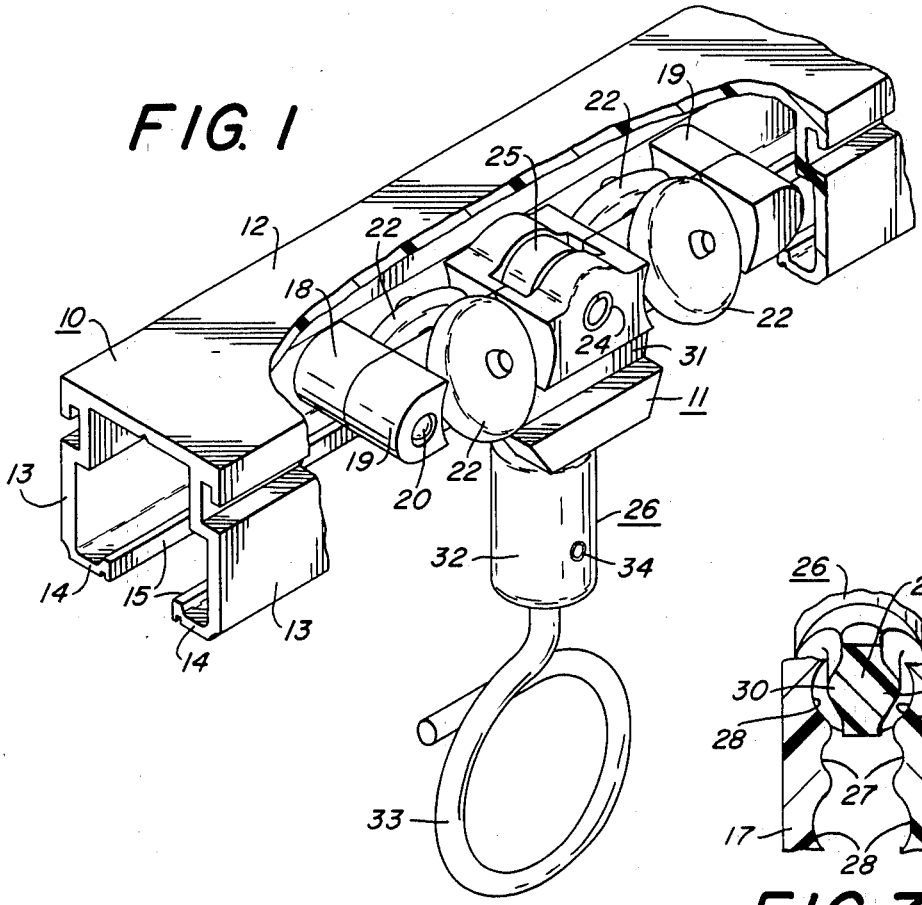
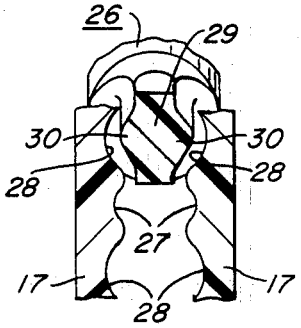
FIG. 7
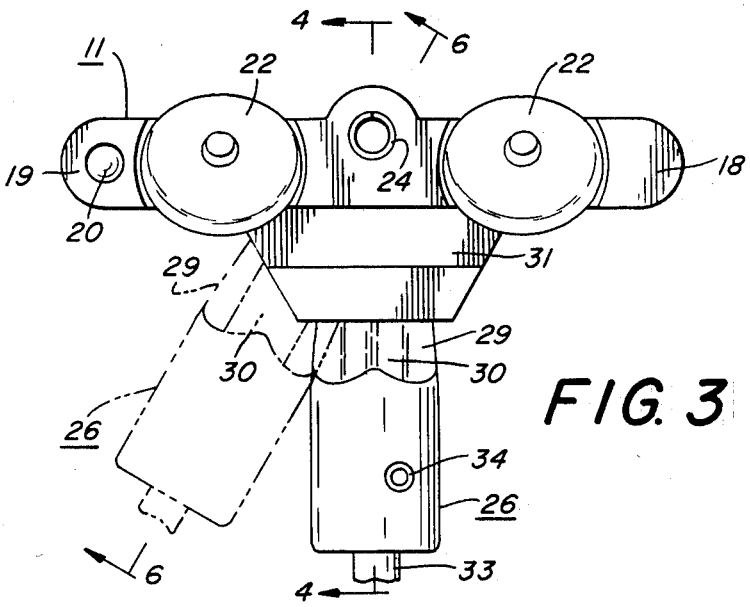
FIG. 3

FIG. 2
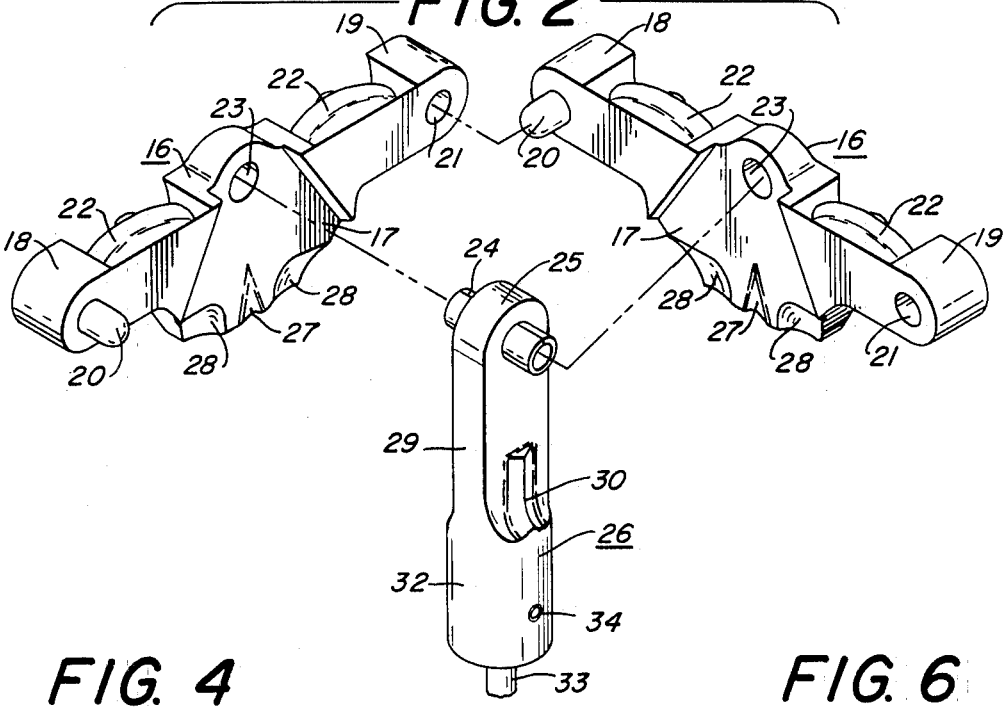
FIG. 4
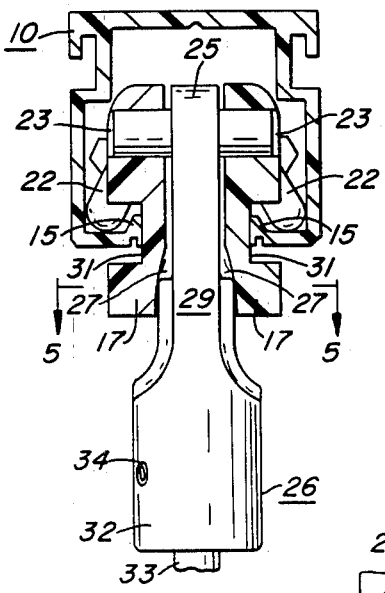
FIG. 6
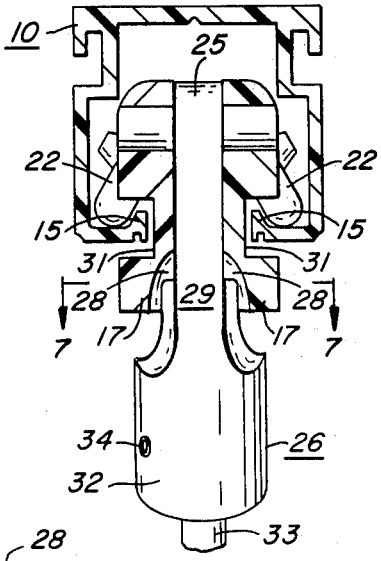
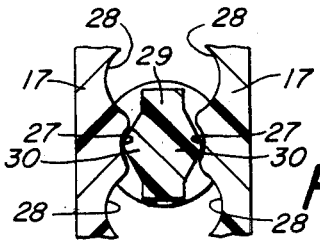
FIG. 5

WHEELED LOCKING CARRIER

This invention relates generally to wheeled carrier devices of the type which travel in ceiling mounted tracks for carrying various articles suspended therefrom, and more particularly relates to a novel wheeled carrier which may be locked in position at a desired location so that it does not drift through the track, and can be quickly unlocked from floor level to move a suspended article to a different location, thereafter being relockable to stabilize the position.

Briefly, the locking wheeled carrier includes a pair of identical molded half carriage parts each of which carries a pair of canted wheels to support the carrier within a track, and a pendulum part pivoted between the carriage halves and extending downward through the bottom slot in the ceiling track for suspending a desired article. The two carriage halves are slidably interfitted with one another for lateral movement toward and away from one another within the ceiling track, and the pendulum pivot extends slidably through both carriage halves. In the vertical pendulum position a camming action exerted by the pendulum on the two carriage halves forces the carriage halves laterally apart from one another so that their outside surfaces engage the ceiling track slot walls and frictionally lock the carriage in position. When the pendulum is pivoted longitudinally in either direction relative to the carriage halves and the running length of the ceiling track, the lateral camming action exerted by the pendulum on the carriage halves is released so that the outer surfaces of the carriage halves disengage from the ceiling track slot wall side surfaces and the carriage is free to travel through the track, it being relockable in its new position by again moving the pendulum to its vertical position.

The carriage halves, wheels and pendulum are made of molded plastic parts for economy, uniformity, and smooth, quiet low friction movement. The pendulum pivot pin is preferably made of steel for strength and may be a rollpin. The three main parts of the assembly, namely the two carriage halves and the pendulum, are slidably fitted together for easy disassembly and reassembly for replacement of any part which might become damaged in use.

A primary object of the invention is to provide a novel locking wheeled carrier for suspension of articles which it is desired to move from one location to another along the course of an overhead track.

Another object of the invention is to provide a novel locking wheeled carrier as aforesaid which includes a pair of identical carriage halves slidably interfitted with one another and with a depending pendulum part pivotally fitted to the carriage halves and disposed therebetween.

A further object of the invention is to provide a novel locking wheeled carrier as aforesaid in which the depending pendulum part and the carriage halves are formed with complementally formed interengaging cam surfaces in which the pendulum in one position locks the carrier in its track against movement, and in another position releases the carriage for movement through the track.

The foregoing and other objects of the invention will appear more clearly hereinafter from a reading of the following specification in conjunction with an examination of the appended drawings, wherein:

FIG. 1 is a perspective view of the locking wheeled carrier according to the invention disposed within a ceiling track, a portion of the track being broken away to disclose the carrier therewithin;

FIG. 2 is an exploded perspective view of the carrier according to the invention showing the two identical carriage halves and the pendulum which is held therebetween;

FIG. 3 is a side elevational view of the carrier according to the invention showing the pendulum in carriage locking position in solid line, and in carriage releasing position in phantom outline;

FIG. 4 is a vertical sectional view through the locking wheeled carrier as would be seen when viewed along the line 4—4 on FIG. 3 and showing the locked relationship of the parts;

FIG. 5 is a horizontal section through the locking cam structure as would be seen when viewed along line 5—5 on FIG. 4;

FIG. 6 is a longitudinal section through the carrier according to the invention as would be seen when viewed along the line 6—6 on FIG. 3, and shows the carriage in its released condition for travel through the ceiling track; and FIG. 7 is a horizontal section through the carriage cam structure as would be seen when viewed along the line 7—7 on FIG. 6.

In the several figures, like elements are denoted by like reference characters.

Referring now to the drawings there is seen a ceiling track 10 within which is disposed the locking carrier according to the invention designated generally as 11. The track 10 includes a top wall 12, sidewalls 13, bottom walls 14 and slot-forming sidewalls 15 extending upward from the inner edges of the track bottom walls 14. The wheeled carrier includes a pair of identical carriage halves 16 each of which is formed with a central block 17 from which extend in opposite directions arms 18 and 19. The arms 18 are each formed with a pin extension 20 which is slidably interfittable with a bore 21 formed at the end of the arm 19. Carried on the outside faces of the arms 18 and 19 between the ends of the arms and the central block 17 are carriage wheels 22, the wheels being carried in an angled or canted manner as best seen in FIGS. 4 and 6 to ride on the track bottom walls 14. The cant of the wheels prevents crab walking of the carrier within the track.

The central block 17 of each carriage halve 16 is formed with a bore 23 to freely rotatably receive a pivot pin 24 which passes through the head 25 of the pendulum designated generally as 26. Formed centrally at the bottom inside face of the central block 17 are the central locking camming recess 27 and the release recesses 28 disposed longitudinally on either side of the central locking recess 27, these recesses cooperating with the camming structure of the pendulum 26 to respectively lock and release the carriage.

Depending from the pendulum head 25 is a pendulum camming shank 29 which is generally rectangular in cross-section with the major axis extending parallel to the longitudinal extent of the carriage halves and having extending laterally from the longer side surfaces of the camming shank in opposite directions a pair of triangular camming surfaces 30 the apices of which are smoothly rounded to conformingly fit within the central locking camming recesses 27 on the carriage halves central blocks 17 when the pendulum 26 is in its vertical locking position as seen in FIGS. 4 and 5. When the pendulum 26 is in its released position as seen in FIGS. 6 and 7, the camming surfaces 30 are freely disposed within the release recesses 28.

As best seen in FIG. 6, with the pendulum in its unlocked or release position, the outer side surface 31 of the carriage halves central blocks 17 are disengaged from the track slot sidewalls 15 so that the carriage may move freely through the track. The force vectors on the carriage wheels 22 are such as to cause the two carriage halves to tend to ride inward toward one another to provide the required clearance for free movement. As best seen in FIG. 4, in carriage locking condition the carriage halves 16 have been forced laterally apart, so that the carriage outer sidewalls 31 are frictionally engaged against the track slot sidewalls 15 to hold the carriage in fixed position within the track. The separation of the carriage sidewalls is clearly seen in FIG. 4 as compared to the closer positioning seen in FIG. 6.

Depending from the bottom section 32 of the pendulum is a loop 33 secured into the pendulum bottom section 32 by means of a pin 34. With the locking wheeled carrier disposed within a ceiling track as shown, an article may be hung from the loop 33, as for example an intravenous fluid container carrier, for use at the bedside of a patient. By pulling laterally on the intravenous carrier, the pendulum 26 may be snapped out of its center detented position and pulled along through the track by the intravenous carrier to a desired location, upon which by swinging the intravenous carrier back down to a vertical position the pendulum 26 is restored to its vertical position where the carriage is again locked against movement. Since release recesses 28 are formed on both sides of the central locking recess 27, it is clear that the locking wheeled carrier 11 may be moved in either direction through the track.

Having now described the invention in connection with a particularly illustrated embodiment thereof, it will be understood that modifications and variations of the invention may now naturally occur from time to time to those persons normally skilled in the art without departing from the essential scope or spirit of the invention, and accordingly it is intended to claim the same broadly as well as specifically as indicated by the appended claims.

What is claimed is:

1. A locking wheeled carrier for use in conjunction with a suspended hollow track, said track being of the type having a top, sides and a pair of bottom walls turned inward toward one another from the bottoms of the sides and terminating in parallel spaced apart slot defining sidewalls which define a continuous longitudinally extending slot, said carrier comprising in combination, (a) a wheeled carriage in which the wheels are seatable upon the track bottom walls for movement of the carriage through the track, (b) a pair of spaced apart locking blocks carried by said carriage and extending downward between the track slot defining sidewalls, said locking blocks (1) being free to move within limits toward and away from one another widthwise of the track, (2) carrying camming elements, and (3) having locking surfaces facing the track slot defining sidewalls, and (c) a shiftable carrier element depending from said wheeled carriage, said carrier element carrying camming elements adapted to coact with the said camming elements of said locking blocks so that movement of said carrier element in a first way relatively to said locking blocks causes said coacting camming elements to engage and move said locking blocks into engagement with the track slot defining sidewalls to thereby lock the carriage in the track, and movement of said carrier element in a second way relatively to said locking blocks causes said coacting camming elements to disengage sufficiently to release said locking blocks from engagement with the track slot defining sidewalls to thereby release the carriage for movement in the track.

2. A locking wheeled carrier as defined in claim 1 wherein said locking blocks comprise a pair of apposing faces and said camming elements carried by said locking blocks are carried on the said apposing faces.

3. A locking wheeled carrier as defined in claim 1 wherein said shiftable carrier element depends between said pair of locking blocks.

4. A locking wheeled carrier as defined in claim 1

(a) wherein said locking blocks comprise a pair of apposing faces and said camming elements carried by said locking blocks are carried on the said apposing faces, and (b) wherein said shiftable carrier element depends between said pair of locking blocks and carries its said camming elements in facing relation to the said camming elements on said locking blocks apposing faces.

5. A locking wheeled carrier as defined in claim 4 wherein said carrier element is pivotally secured to said wheeled carriage for swinging movement relative thereto.

6. A locking wheeled carrier as defined in claim 4 wherein said wheeled carriage comprises a pair of identical carriage halves.

7. A locking wheeled carrier as defined in claim 6 wherein said movement of said carrier element in a first way relatively to said locking blocks to lock said wheeled carriage is a movement in a direction aided by gravity, and wherein said movement of said carrier element in a second way relatively to said locking blocks to release said wheeled carriage is a movement in a direction opposed by gravity.

8. A locking wheeled carrier as defined in claim 7 wherein the wheels comprise two pairs, one pair of wheels being positioned on each side of said shiftable carrier element, and the wheels of each pair being canted toward one another at their upper ends and being canted away from one another at their lower ends where they seat on the track bottom walls.

9. A locking wheeled carrier as defined in claim 4 wherein said wheeled carriage comprises a pair of identical carriage halves, and wherein each one of said pair of locking blocks is formed integrally with a carriage half.

10. A locking wheeled carrier as defined in claim 1 wherein said carrier element is pivotally secured to said wheeled carriage for swinging movement relative thereto.

11. A locking wheeled carrier as defined in claim 10 wherein said movement of said carrier element in a first way relatively to said locking blocks to lock said wheeled carriage is a movement in a direction aided by gravity, and wherein said movement of said carrier element in a second way relatively to said locking blocks to release said wheeled carriage is a movement in a direction opposed by gravity.

12. A locking wheeled carrier as defined in claim 1 wherein said wheeled carriage comprises a pair of identical carriage halves.

13. A locking wheeled carrier as defined in claim 1 wherein said wheeled carriage comprises a pair of identical carriage halves, and wherein each one of said pair of locking blocks is formed integrally with a carriage half.

14. A locking wheeled carrier as defined in claim 13 wherein said movement of said carrier element in a first way relatively to said locking blocks to lock said wheeled carriage is a movement in a direction aided by gravity, and wherein said movement of said carrier element in a second way relatively to said locking blocks to release said wheeled carriage is a movement in a direction opposed by gravity.

15. A locking wheeled carrier as defined in claim 1 wherein said movement of said carrier element in a first way relatively to said locking blocks to lock said wheeled carriage is a movement in a direction aided by gravity, and wherein said movement of said carrier element in a second way relatively to said locking blocks to release said wheeled carriage is a movement in a direction opposed by gravity.

16. A locking wheeled carrier as defined in claim 1 wherein the wheels comprise two pairs, one pair of wheels being positioned on each side of said shiftable carrier element, and the wheels of each pair being canted toward one another at their upper ends and being canted away from one another at their lower ends where they seat on the track bottom walls.

* * * * *